US009026319B2

(12) United States Patent
Hayashi et al.

(10) Patent No.: US 9,026,319 B2
(45) Date of Patent: May 5, 2015

(54) BLADE CONTROL DEVICE, WORKING MACHINE AND BLADE CONTROL METHOD

(71) Applicant: Komatsu Ltd., Tokyo (JP)

(72) Inventors: Kazuhiko Hayashi, Komatsu (JP); Kenjiro Shimada, Komatsu (JP); Kenji Okamoto, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 35 days.

(21) Appl. No.: 14/113,605

(22) PCT Filed: Nov. 20, 2012

(86) PCT No.: PCT/JP2012/080015
§ 371 (c)(1),
(2) Date: Oct. 24, 2013

(87) PCT Pub. No.: WO2014/064850
PCT Pub. Date: May 1, 2014

(65) Prior Publication Data

US 2015/0019086 A1 Jan. 15, 2015

(30) Foreign Application Priority Data

Oct. 26, 2012 (JP) ..... 2012-236465

(51) Int. Cl.
*E02F 3/84* (2006.01)
*E02F 3/76* (2006.01)

(52) U.S. Cl.
CPC ..... *E02F 3/844* (2013.01); *E02F 3/7609* (2013.01)

(58) Field of Classification Search
USPC ..... 701/50; 172/4
See application file for complete search history.

(56) References Cited

U.S. PATENT DOCUMENTS 5,564,507 A 10/1996 Matsushita et al.

FOREIGN PATENT DOCUMENTS

JP 7-54374 A 2/1995
JP 2001-500937 A 1/2001

OTHER PUBLICATIONS

International Search Report for PCT/JP2012/080015 issued on Feb. 26, 2013.

*Primary Examiner* — John Q Nguyen
*Assistant Examiner* — Kyung Kim
(74) *Attorney, Agent, or Firm* — Global IP Counselors, LLP

(57) ABSTRACT

When a blade load is reduced from a value greater than or equal to a first set load value to a value less than the first set load value, a blade control device is configured to set a virtual designed surface to be closer to a blade than a designed surface is, and is configured to allow the blade to pivot above the virtual designed surface.

7 Claims, 9 Drawing Sheets

BLADE CONTROL DEVICE, WORKING MACHINE AND BLADE CONTROL METHOD

CROSS-REFERENCE TO RELATED APPLICATIONS

This application claims priority to Japanese Patent Application No. 2012-236465 filed on Oct. 26, 2012. This application is a U.S. National stage application of International Application No. PCT/JP2012/080015 filed on Nov. 20, 2012.

FIELD OF THE INVENTION

The present invention relates to a blade control device for controlling the height of a blade, a working machine and a blade control method.

BACKGROUND INFORMATION

Working machines have been widely used so far, which are equipped with a blade as a work implement in use for digging and leveling the ground, transporting earth and sand, and so forth. Further, a method has been proposed for automatically regulating the height of the blade in such a working machine so that a blade load acting on the blade can fall in a target range (see Japan Laid-open Patent Application Publication No. JP-A-H07-54374).

SUMMARY

However, according to the method described in Japan Laid-open Patent Application Publication No. JP-A-H07-54374, the blade is elevated in conjunction with the fact that the blade load becomes greater than the upper limit of the target range, and subsequently, is configured to be lowered in conjunction with the fact that the blade load becomes less than the lower limit of the target range. Therefore, the method described in Japan Laid-open Patent Application Publication No. JP-A-H07-54374 has a drawback that continuous undulations are inevitably formed on a digging surface.

The present invention has been produced in view of the aforementioned situation, and is intended to provide a blade control device, a working machine and a blade control method, whereby undulation of a digging surface can be inhibited.

A blade control device according to a first aspect is used for controlling an up-and-down position of a blade as a work implement to be pivotally attached to a vehicle body. The blade control device includes a blade load obtaining part, a blade controlling part, a distance obtaining part and a virtual designed surface setting part. The blade load obtaining part is configured to obtain a blade load acting on the blade. The blade controlling part is configured to: lower the blade when the blade load is less than a first set load value; and elevate the blade when the blade load is greater than a second set load value, and is configured to allow the blade to pivot above a designed surface as a three-dimensional designed landform indicating a target shape of a digging object. The distance obtaining part is configured to obtain a distance between the designed surface and the blade. The virtual designed surface setting part is configured to set a virtual designed surface to be arranged in parallel to the designed surface and be closer to the blade than the designed surface is to the blade based on a reference distance to be obtained by the distance obtaining part at the time the blade load is reduced from a value greater than or equal to the first set load value to a value less than the first set load value. The blade controlling part is configured to allow the blade to pivot above the virtual designed surface even though the blade load is less than the first set load value if the virtual designed surface had been set by the virtual designed surface setting part.

According to the blade control device of the first aspect, the blade is controlled so as not to be closer to the designed surface than the virtual designed surface is, even when the blade load became less than the first set load value after blade elevation executed in accordance with the fact that the blade load had become greater than the second set load value during execution of a digging work. The blade can be thereby inhibited from being greatly lowered. Accordingly, continuous undulations can be inhibited from being formed on the digging surface.

A blade control device according to a second aspect relates to the blade control device according to the first aspect, and wherein the virtual designed surface setting part is configured to set the virtual designed surface so that a distance between the virtual designed surface and the designed surface is equal to the reference distance.

A blade control device according to a third aspect relates to the blade control device according to the first aspect, and wherein the virtual designed surface setting part is configured to set the virtual designed surface so that a distance between the virtual designed surface and the designed surface can be less than the reference distance.

According to the blade control device of the third aspect, a required dozing amount can be reliably obtained, while a large undulation can be prevented from being formed on the digging surface.

A blade control device according to a fourth aspect relates to the blade control device according to the third aspect, and wherein the virtual designed surface setting part is configured to set the virtual designed surface in a position farther away from the designed surface than a previously set virtual designed surface is.

According to the blade control device of the fourth aspect, even when the virtual designed surface is set so that the distance between the virtual designed surface and the designed surface can be less than the reference distance, an updated virtual designed surface can be inhibited from being set to be below the previous virtual designed surface. Therefore, an undulation can be further inhibited from being formed on the digging surface.

A working machine according to a fifth aspect includes: a vehicle body; a blade as a work implement to be pivotally attached to the vehicle body; and the blade control device according to the first aspect.

A blade control method according to a sixth aspect is used for controlling an up-and-down position of a work implement to be pivotally attached to a vehicle body. The blade control method includes the steps of: setting a virtual designed surface to be arranged in parallel to a designed surface as a three-dimensional designed landform indicating a target shape of a digging object and be closer to the blade than the designed surface is to the blade based on a reference distance between the designed surface and the blade at the time a blade load acting on the blade is reduced from a value greater than or equal to a first set load value to a value less than the first set load value; and allowing the blade to pivot above the virtual designed surface.

A blade control method according to a seventh aspect is used for controlling an up-and-down position of a blade as a work implement that is used for digging and pivotally attached to a vehicle body of a working machine. The blade control method includes the steps of obtaining a blade load acting on the blade in the digging; and lowering the blade when the blade load is less than a first set load value and elevating the blade when the blade load becomes greater than a second set load value, while allowing the blade to pivot only above a designed surface as a three-dimensional designed landform indicating a target shape of a digging object. The step of lowering the blade includes: setting a virtual designed surface to be above the designed surface; and allowing the blade to pivot above the virtual designed surface.

According to the present invention, it is possible to provide a blade control device whereby undulation of a digging surface can be inhibited, a working machine and a blade control method.

DESCRIPTION OF EMBODIMENTS

A bulldozer will be hereinafter explained as an example of "working machine" with reference to the drawings. In the following explanation, "up", "down", "front", "rear", "left" and "right" are terms defined with reference to an operator seated on an operator seat.

Overall Structure of Bulldozer 100

Figure 1:
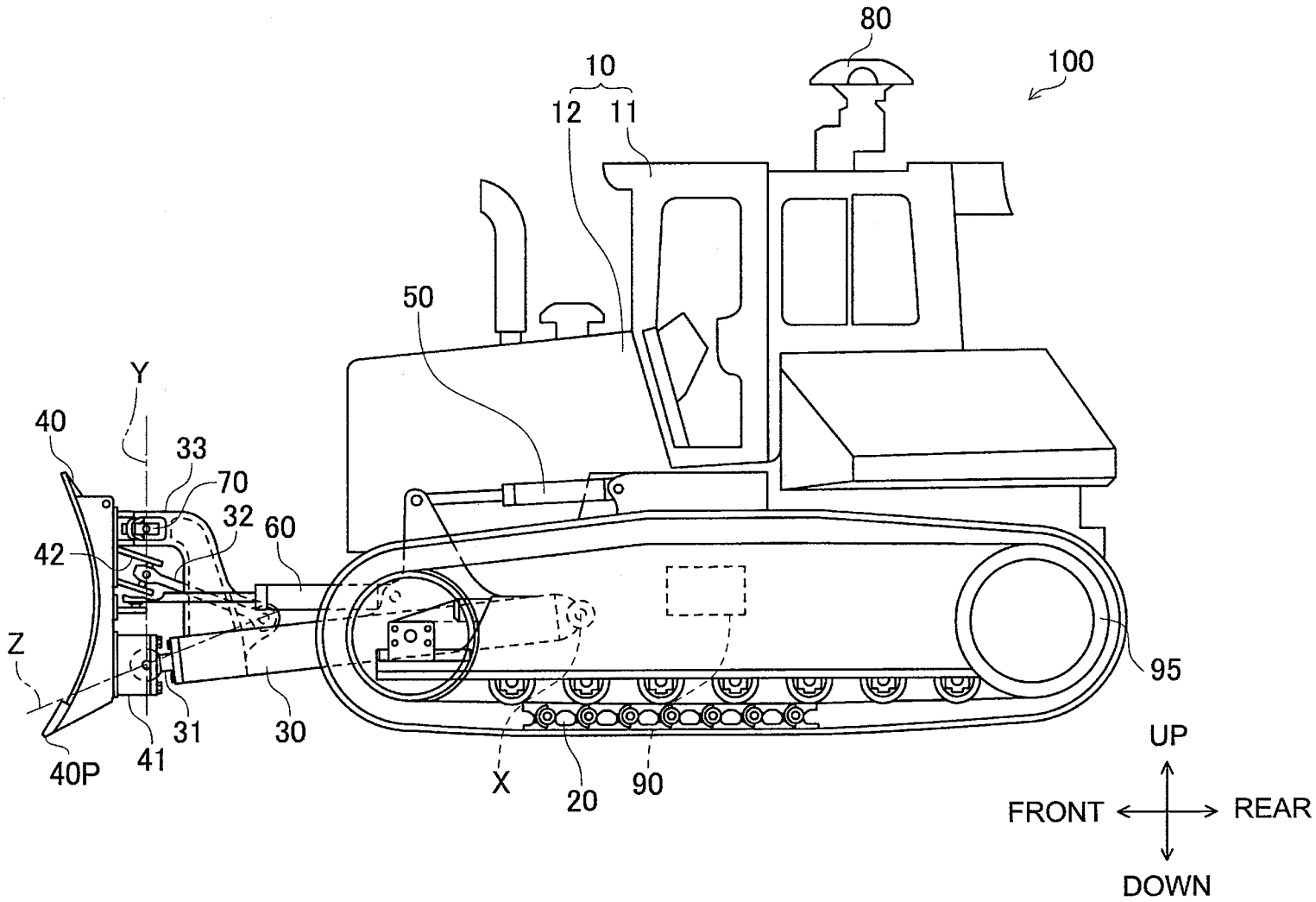
FIG. 1 is a side view of an entire structure of a bulldozer.

FIG. 1 is a side view of an entire structure of a bulldozer 100.

The bulldozer 100 includes a vehicle body 10, a driving unit 20, a lift frame 30, a blade 40, a lift cylinder 50, an angle cylinder 60, a tilt cylinder 70, a GPS receiver 80, an IMU (Inertial Measurement Unit) 90 and a pair of sprockets 95. Further, the bulldozer 100 is embedded with a blade control device 200 (see FIG. 3). A structure and an action of the blade control device 200 will be described below.

The vehicle body 10 includes a cab 11 and an engine compartment 12. The operator seat and a variety of operating devices (which are not illustrated in the figures) are installed inside the cab 11. The engine compartment 12 is disposed forwards of the cab 11.

The driving unit 20 is formed by a pair of crawler belts (only the left side crawler belt is illustrated in FIG. 1). The driving unit 20 is attached to the lower part of the vehicle body 10. The pair of crawler belts is configured to be circulated in conjunction with driving of the pair of sprockets 95, and this enables the bulldozer 100 to travel.

The lift frame 30 is disposed inwards of the driving unit 20 in the vehicle width direction (i.e., the right-and-left direction). The lift frame 30 is attached to the vehicle body 10 while being pivotable up and down about an axis X arranged in parallel to the vehicle width direction. The lift frame 30 supports the blade 40 through a ball-and-socket joint 31, a pitching support link 32 and a bracing strut 33.

The blade 40 is disposed forwards of the vehicle body 10. The blade 40 includes: a universal coupling 41 coupled to the ball-and-socket joint 31; and a pitching coupling 42 coupled to the pitching support link 32. The blade 40 is configured to be moved up and down in conjunction with up-and-down pivot of the lift frame 30. The blade 40 has a cutting edge 40P formed on the bottom end thereof. The cutting edge 40P is shoved into the ground in a leveling work or a digging work.

The lift cylinder 50 is coupled to the vehicle body 10 and the lift frame 30. In conjunction with extension and contraction of the lift cylinder 50, the lift frame 30 is configured to pivot up and down about the axis X.

Figure 2:
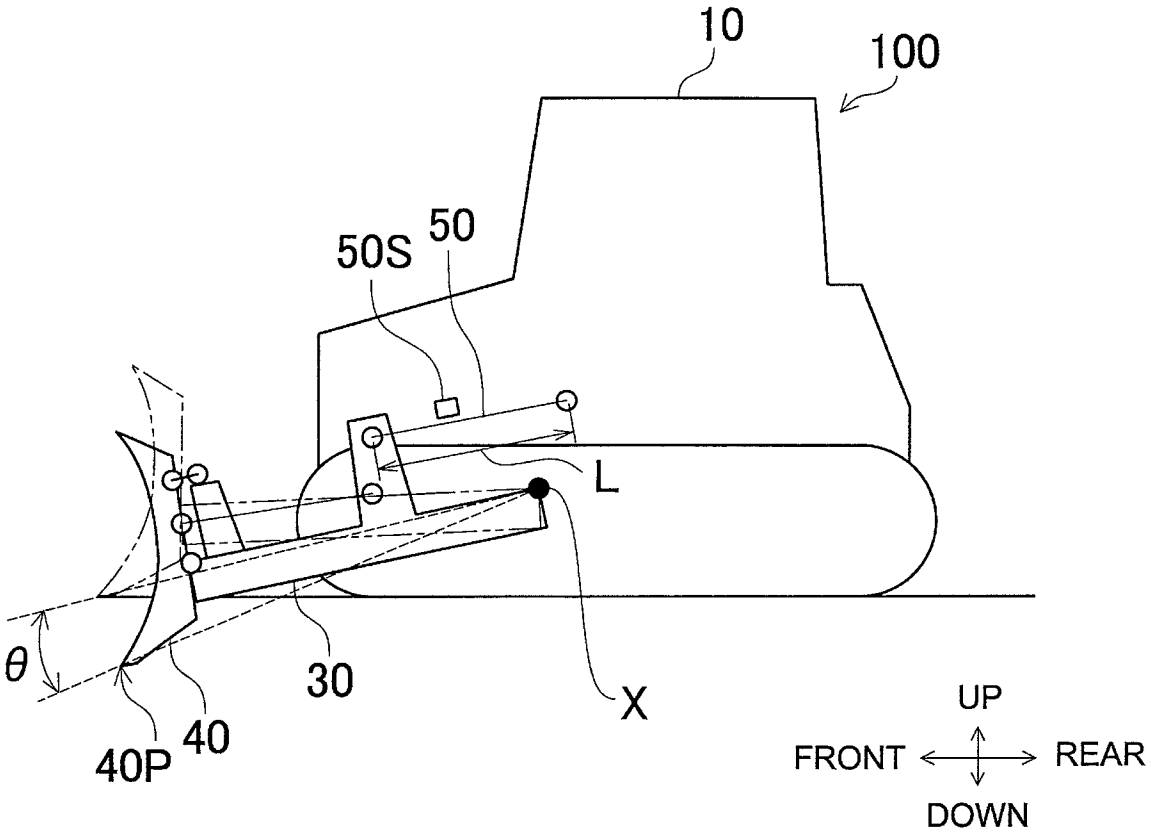
FIG. 2 is a schematic view of a structure of the bulldozer.

Now, FIG. 2 is a schematic diagram representing a structure of the bulldozer 100. In FIG. 2, the original position of the lift frame 30 is depicted with a dashed two-dotted line. When the lift frame 30 is positioned in the original position, the cutting edge 40P of the blade 40 is configured to make contact with the ground. As illustrated in FIG. 2, the bulldozer 100 includes a lift cylinder sensor 50S. The lift cylinder sensor 50S is formed by: a rotatable roller for detecting the position of a rod; and a magnetic sensor for returning the rod to its original position. The lift cylinder sensor 50S is configured to detect the stroke length of the lift cylinder 50 (hereinafter referred to as "a lift cylinder length L"). As described below, a blade controller 210 (see FIG. 3) is configured to calculate a lift angle θ of the blade 40 based on the lift cylinder length L. The lift angle θ corresponds to a lowered angle of the blade 40 from the original position, i.e., the depth of the cutting edge 40P shoved into the ground. The bulldozer 100 is configured to execute a digging work, when being forwardly moved while the blade 40 is lowered from its original position.

The angle cylinder 60 is coupled to the lift frame 30 and the blade 40. In conjunction with extension or contraction of the angle cylinder 60, the blade 40 is configured to pivot about an axis Y passing through the rotary center of the universal coupling 41 and that of the pitching coupling 42.

The tilt cylinder 70 is coupled to the bracing strut 33 of the lift frame 30 and the right upper end of the blade 40. In conjunction with extension or contraction of the tilt cylinder 70, the blade 40 is configured to pivot about an axis Z connecting the ball-and-socket joint 31 and the bottom end of the pitching support link 32.

The GPS receiver 80 is disposed on the cab 11. The GPS receiver 80 is an antenna for GPS (Global Positioning System). The GPS receiver 80 is configured to receive a set of GPS data indicating the position thereof.

The IMU 90 is an inertial measurement unit configured to obtain a set of vehicle body slant angle data indicating front, rear, right and left slant angles of the vehicle body with respect to the horizontal direction. The IMU 90 is configured to transmit the set of vehicle body slant angle data to the blade controller 210.

The pair of sprockets 95 is configured to be driven by an engine (not illustrated in the figures) accommodated in the engine compartment 12. The driving unit 20 is configured to be driven in conjunction with driving of the pair of sprockets 95.

Structure of Blade Control Device 200

Figure 3:
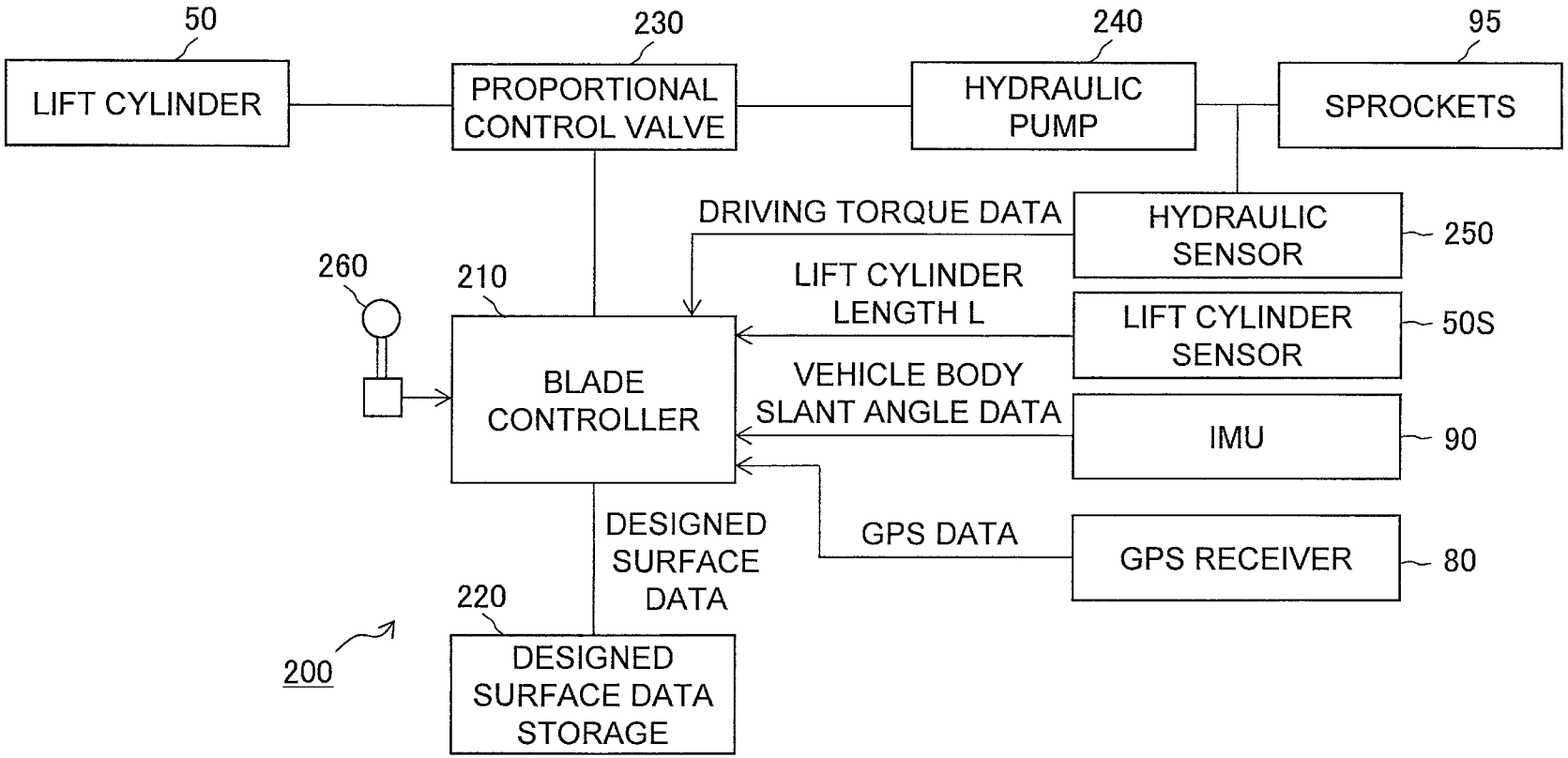
FIG. 3 is a configuration block diagram of a blade control device.

FIG. 3 is a configuration block diagram of the blade control device 200 according to an exemplary embodiment.

The blade control device 200 includes the blade controller 210 and a designed surface data storage 220. Further, as represented in FIG. 3, the bulldozer 100 includes a proportional control valve 230, a hydraulic pump 240 and a hydraulic sensor 250 in addition to the aforementioned components, i.e., the lift cylinder 50, the lift cylinder sensor 50S, the GPS receiver 80 and the IMU 90.

The blade controller 210 is configured to obtain the lift cylinder length L from the lift cylinder sensor 50S. The blade controller 210 is configured to obtain the set of GPS data from the GPS receiver 80. The blade controller 210 is configured to obtain the set of vehicle body slant angle data from the MU 90. The blade controller 210 is configured to obtain, from the hydraulic sensor 250, a set of pressure data of the operating oil to be supplied to the pair of sprockets 95 from the hydraulic pump 240. The blade controller 210 is configured to output a control signal (electric current) to the proportional control valve 230 based on the sets of data. Accordingly, the blade controller 210 is configured to automatically regulate the height of the blade 40 so that the load acting on the blade 40 (hereinafter referred to as "blade load") can fall in a target range. Functions of the blade controller 210 will be described below.

The designed surface data storage 220 has preliminarily stored a set of designed surface data indicating a position and a shape of a three-dimensional designed landform (hereinafter referred to as "a designed surface $A_{STD}$") that indicates a target shape of a digging object within a work area.

The proportional control valve 230 is disposed between the lift cylinder 50 and the hydraulic pump 240. The opening degree of the proportional control valve 230 is configured to be controlled by means of electric current as a control signal from the blade controller 210.

The hydraulic pump 240 is configured to be operated in conjunction with the engine and is configured to supply the operating oil for driving the pair of sprockets 95. The hydraulic pump 240 is configured to supply the operating oil to the lift cylinder 50 via the proportional control valve 230.

The hydraulic sensor 250 is configured to detect the pressure of the operating oil to be supplied to the pair of sprockets 95 from the hydraulic pump 240. The pressure to be detected by the hydraulic sensor 250 corresponds to the traction force of the driving unit 20. Therefore, the blade load can be comprehended based on the pressure to be detected.

Functions of Blade Controller 210

Figure 4:
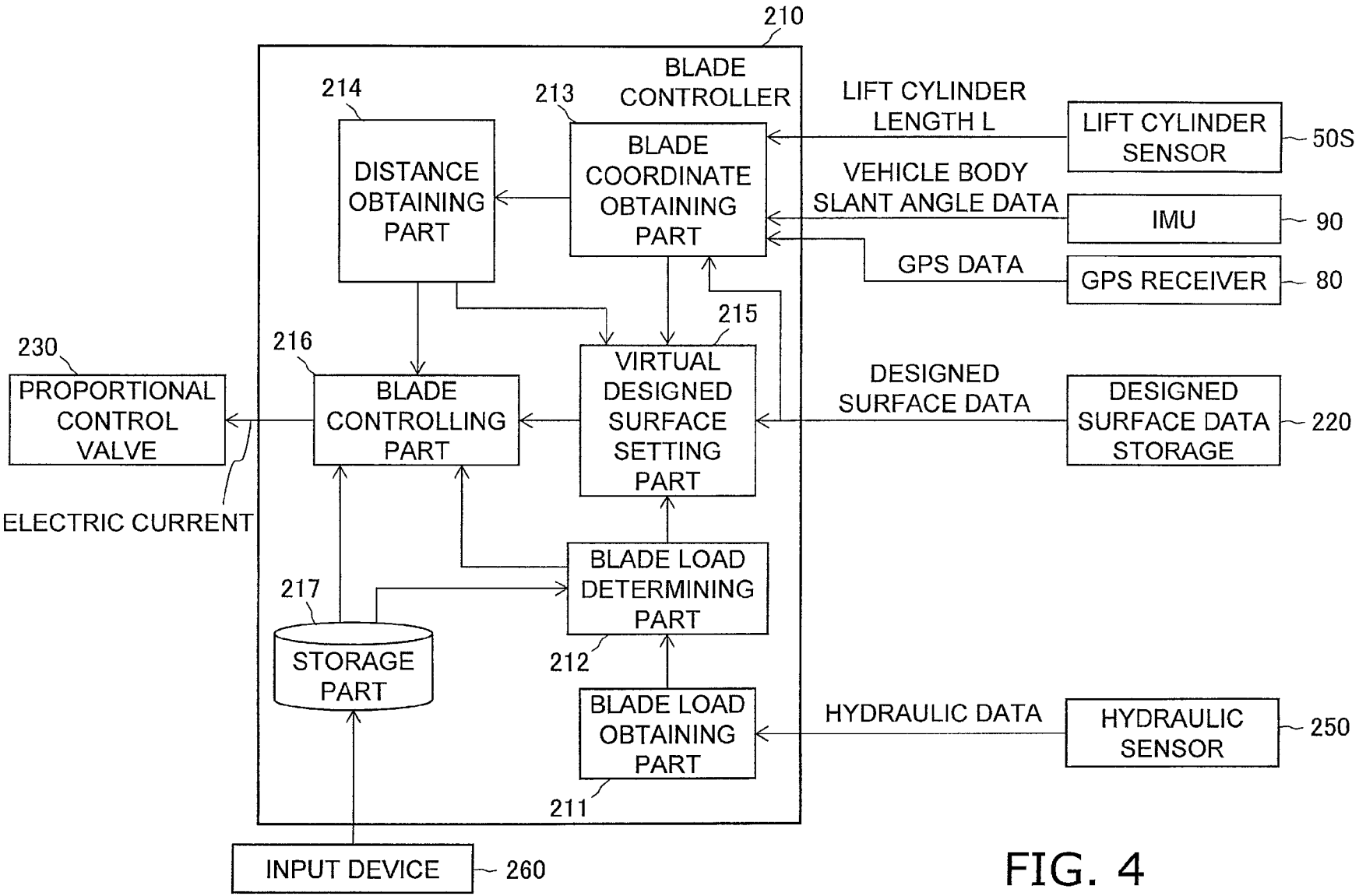
FIG. 4 is a functional block diagram a blade controller.
Figure 5:
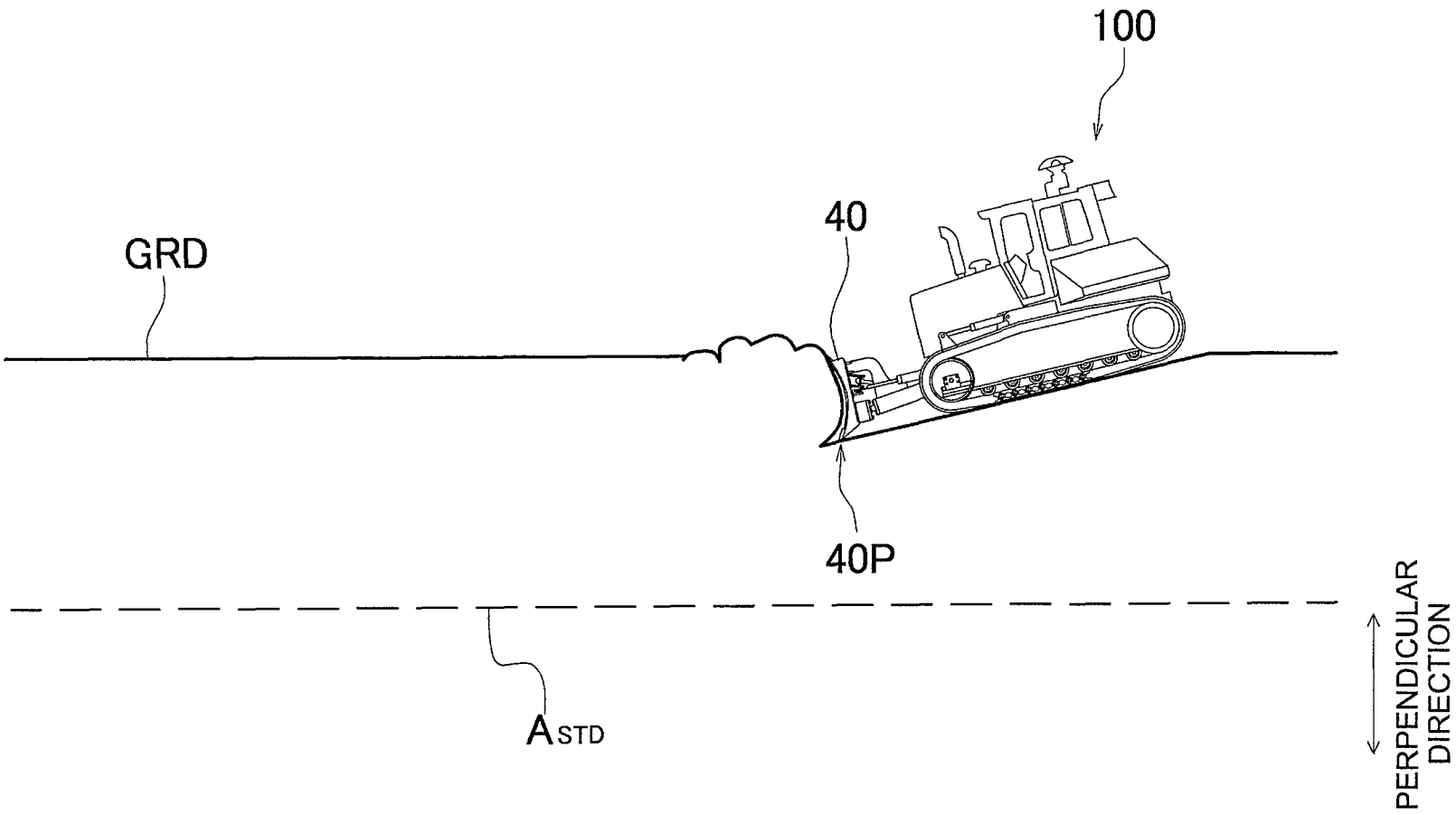
FIG. 5 is a schematic diagram for explaining a condition of a digging work by the bulldozer.
Figure 6:
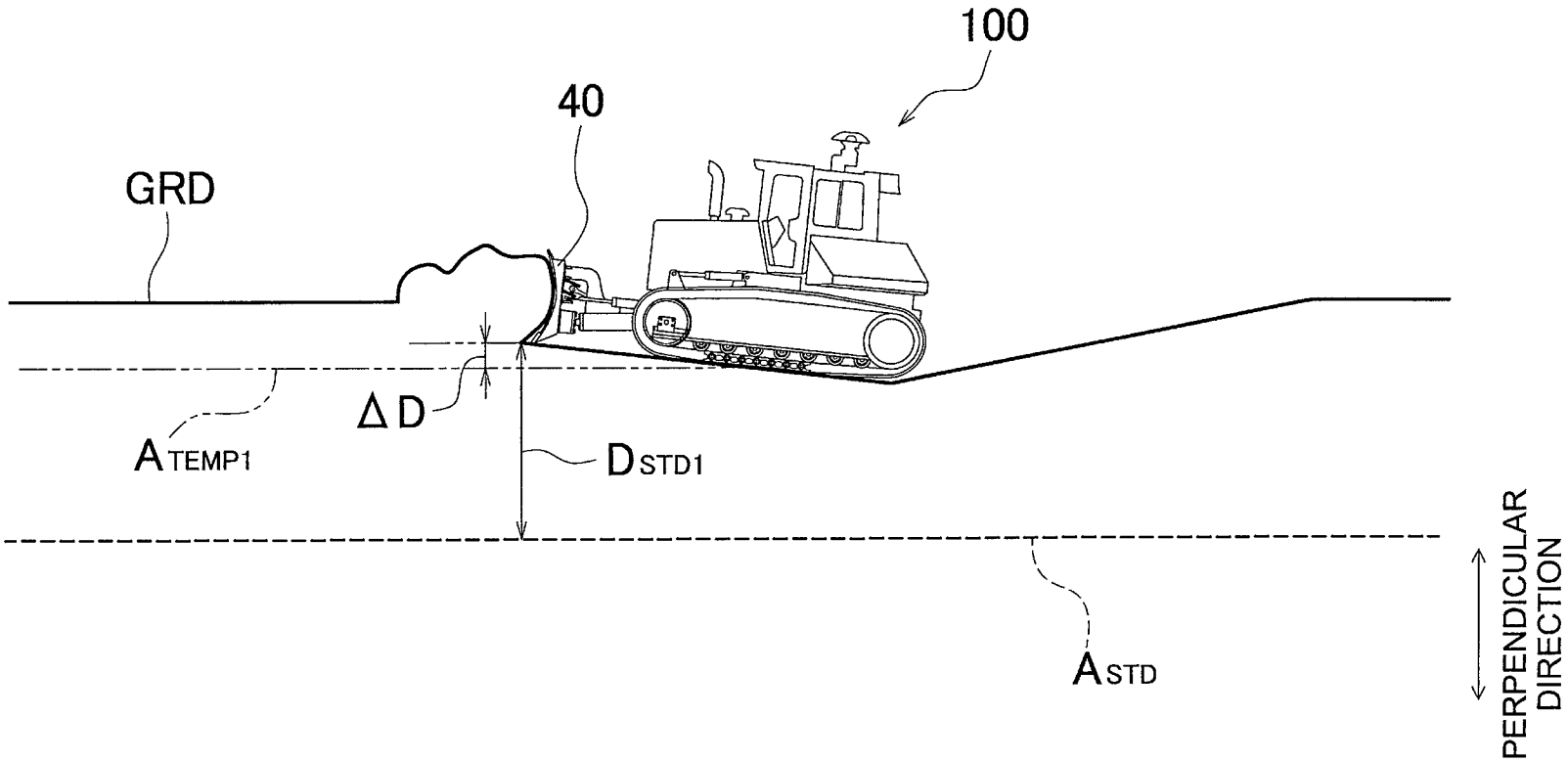
FIG. 6 is a schematic diagram for explaining a condition of a digging work by the bulldozer.
Figure 7:
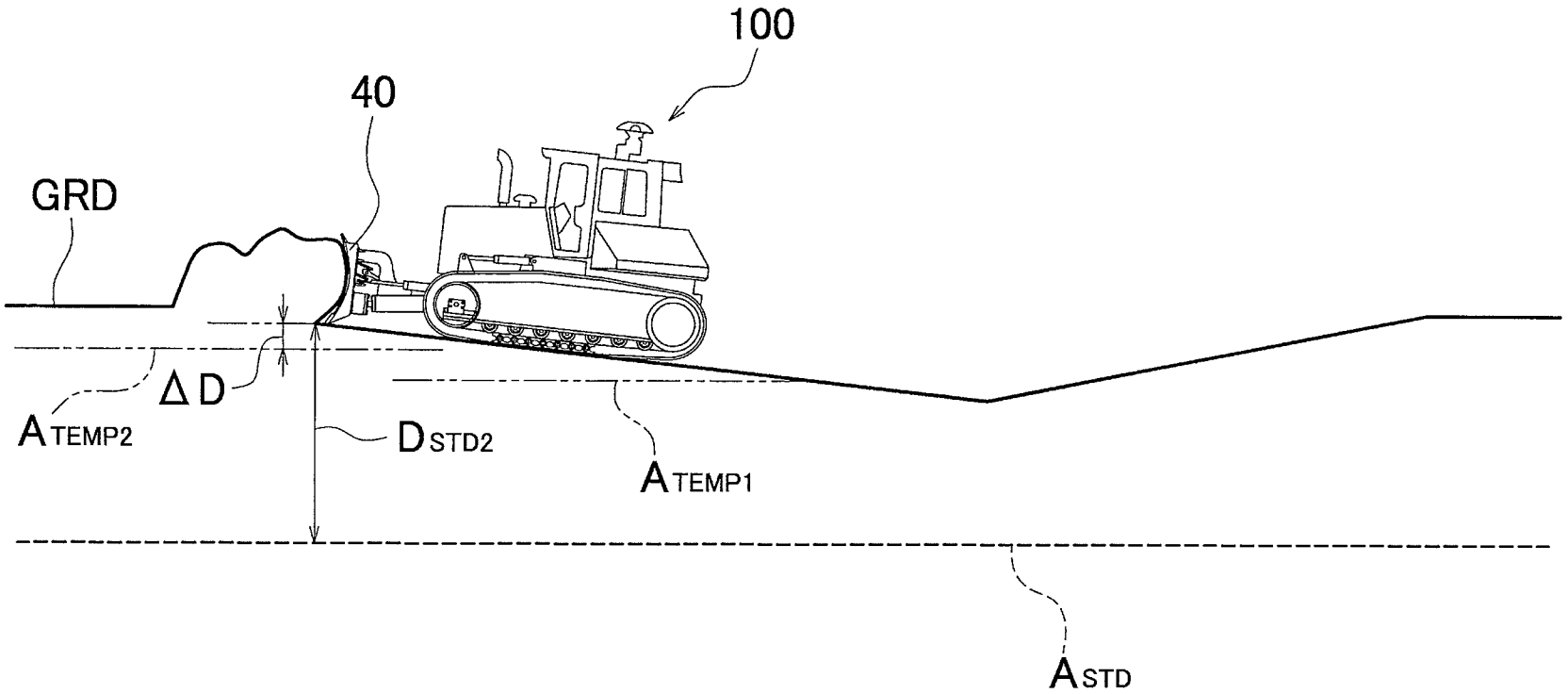
FIG. 7 is a schematic diagram for explaining a condition of a digging work by the bulldozer.

FIG. 4 is a functional block diagram of the blade controller 210. FIGS. 5 to 7 are schematic diagrams for explaining conditions of a digging work by the bulldozer 100. In FIGS. 5 to 7, the conditions of a digging work by the bulldozer 100 are sequentially aligned in a time-series manner.

As represented in FIG. 4, the blade controller 210 includes a blade load obtaining part 211, a blade load determining part 212, a blade coordinate obtaining part 213, a distance obtaining part 214, a virtual designed surface setting part 215, a blade controlling part 216 and a storage part 217.

The blade load obtaining part 211 is configured to obtain, from the hydraulic sensor 250, the set of pressure data of the operating oil to be supplied to the pair of sprockets 95. The blade load obtaining part 211 is configured to obtain the blade load acting on the blade 40 based on the set of pressure data.

The blade load determining part 212 is configured to determine whether or not the blade load obtained by the blade load obtaining part 211 falls within a predetermined range. Specifically, the blade load determining part 212 is configured to determine whether or not the blade load is less than a first set load value $F_{LOW}$. Further, the blade load determining part 212 is configured to determine whether or not the blade load is greater than a second set load value $F_{HIGH}$ that is greater than the first set load value $F_{LOW}$. The blade load determining part 212 is configured to inform the virtual designed surface setting part 215 and the blade controlling part 216 of the determination result. It should be noted that the first set load value $F_{LOW}$ can be set as a value less than a target load F0 (e.g., roughly 0.4 to 0.8 times as much as the weight of the bulldozer 100) by the amount of a predetermined load $\alpha$. The second set load value $F_{HIGH}$ can be set as a value greater than the target load F0 by the amount of the predetermined load $\alpha$.

The blade coordinate obtaining part 213 is configured to obtain the lift cylinder length L, the set of GPS data and the set of vehicle body slant angle data. The blade coordinate obtaining part 213 is configured to compute a global coordinate of the GPS receiver 80 based on the set of GPS data. The blade coordinate obtaining part 213 is configured to calculate the lift angle $\theta$ (see FIG. 2) based on the lift cylinder length L. The blade coordinate obtaining part 213 is configured to compute a local coordinate of the blade 40 (specifically, the blade cutting edge 40P) with respect to the GPS receiver 80 based on the lift angle $\theta$ and a set of vehicle body size data. The blade coordinate obtaining part 213 is configured to compute a global coordinate of the blade 40 based on the global coordinate of the GPS receiver 80, the local coordinate of the blade 40 and the set of vehicle body slant angle data.

The distance obtaining part 214 is configured to obtain the global coordinate of the blade 40 and the set of designed surface data. The distance obtaining part 214 is configured to compute a distance between the designed surface $A_{STD}$ and the blade 40 (hereinafter referred to as "a reference distance $D_{STD}$") based on the global coordinate of the blade 40 and the set of designed surface data. In the present exemplary embodiment, the distance obtaining part 214 is configured to compute, as the reference distance $D_{STD}$, a distance from the designed surface $A_{STD}$ to the cutting edge 40P in a direction perpendicular to the designed surface $A_{STD}$ (hereinafter referred to "a perpendicular direction").

The virtual designed surface setting part 215 is configured to obtain the determination result of the blade load determining part 212. The virtual designed surface setting part 215 is configured to recognize that the blade load has been reduced from a value greater than or equal to the first set load value $F_{LOW}$ to a value less than the first set load value $F_{LOW}$ based on the determination result of the blade load determining part 212. In response to this, the virtual designed surface setting part 215 is configured to obtain, from the distance obtaining part 214, the reference distance $D_{STD}$ where the blade load has been reduced to the value less than the first set load value $F_{LOW}$.

Further, based on the reference distance $D_{STD}$, the virtual designed surface setting part 215 is configured to set a virtual designed surface $A_{TEMP}$ to be closer to the blade 40 than the designed surface $A_{STD}$ is. The virtual designed surface setting part 215 is configured to set the virtual designed surface $A_{TEMP}$ to be in parallel to the designed surface $A_{STD}$.

The virtual designed surface setting part 215 may set the virtual designed surface $A_{TEMP}$ so that the distance between the virtual designed surface $A_{TEMP}$ and the designed surface $A_{STD}$ can be equal to the reference distance $D_{STD}$, or alternatively, may set the virtual designed surface $A_{TEMP}$ so that the distance between the virtual designed surface $A_{TEMP}$ and the designed surface $A_{STD}$ can be less than the reference distance $D_{STD}$. In other words, the virtual designed surface setting part 215 may set the virtual designed surface $A_{TEMP}$ to pass through the cutting edge 40P of the blade 40, or alternatively, may set the virtual designed surface $A_{TEMP}$ to be closer to the designed surface $A_{STD}$ than the blade 40 is.

In the present exemplary embodiment, the virtual designed surface setting part 215 is configured to set the virtual designed surface $A_{TEMP}$ to be in a position closer to the designed surface $A_{STD}$ from the blade 40 by a correction interval ΔD (e.g., roughly several cm). In other words, a virtual distance $D_{TEMP}$ between the virtual designed surface $A_{TEMP}$ and the designed surface $A_{STD}$ can be calculated by the following formula (1).

$$D_{TEMP}=D_{STD}-\Delta D \quad (1)$$

Further, when the blade load is once increased to a value greater than or equal to the first set load value $F_{LOW}$ and is then reduced again to a value less than the first set load value $F_{LOW}$, the virtual designed surface setting part 215 is configured to reset (i.e., update) the virtual designed surface $A_{TEMP}$ based on the reference distance $D_{STD}$ to be obtained anew. At this time, the virtual designed surface setting part 215 is configured to set the virtual designed surface $A_{TEMP}$ to be in a position farther away from the designed surface $A_{STD}$ than the previous position is. Therefore, the virtual designed surface $A_{TEMP}$ is gradually separated away from the designed surface $A_{STD}$ every time update is executed.

The blade controlling part 216 is configured to obtain the determination result of the blade load determining part 212. Based on the determination result of the blade load determining part 212, the blade controlling part 216 is configured to lower the blade 40 when the blade load is less than the first set load value $F_{LOW}$ and is configured to elevate the blade 40 when the blade load is greater than the second set load value $F_{HIGH}$. The blade 40 can be lowered and elevated in conjunction with a control signal to be outputted to the proportional control valve 230 from the blade controlling part 216. The blade controlling part 216 may be configured to regulate the lowering speed and the elevating speed of the blade 40 independently from each other.

The blade controlling part 216 is configured to control the blade 40 not to downwardly go beyond the designed surface $A_{STD}$. Specifically, the blade controlling part 216 is configured to obtain the reference distance $D_{STD}$ from the distance obtaining part 214 and is configured to output a control signal (electric current) to the proportional control valve 230 in order to prevent the reference distance $D_{STD}$ from being less than 0.

Further, when the virtual designed surface $A_{TEMP}$ has been set by the virtual designed surface setting part 215 even though the blade load is less than a predetermined range, the blade controlling part 216 is configured to control the height of the blade 40 in order to prevent the blade 40 from getting closer to the designed surface $A_{STD}$ than the virtual designed surface $A_{TEMP}$ is. In other words, even though the blade load is insufficient, the blade controlling part 216 is configured to control the blade 40 not to downwardly go beyond the virtual designed surface $A_{TEMP}$.

Figure 8:
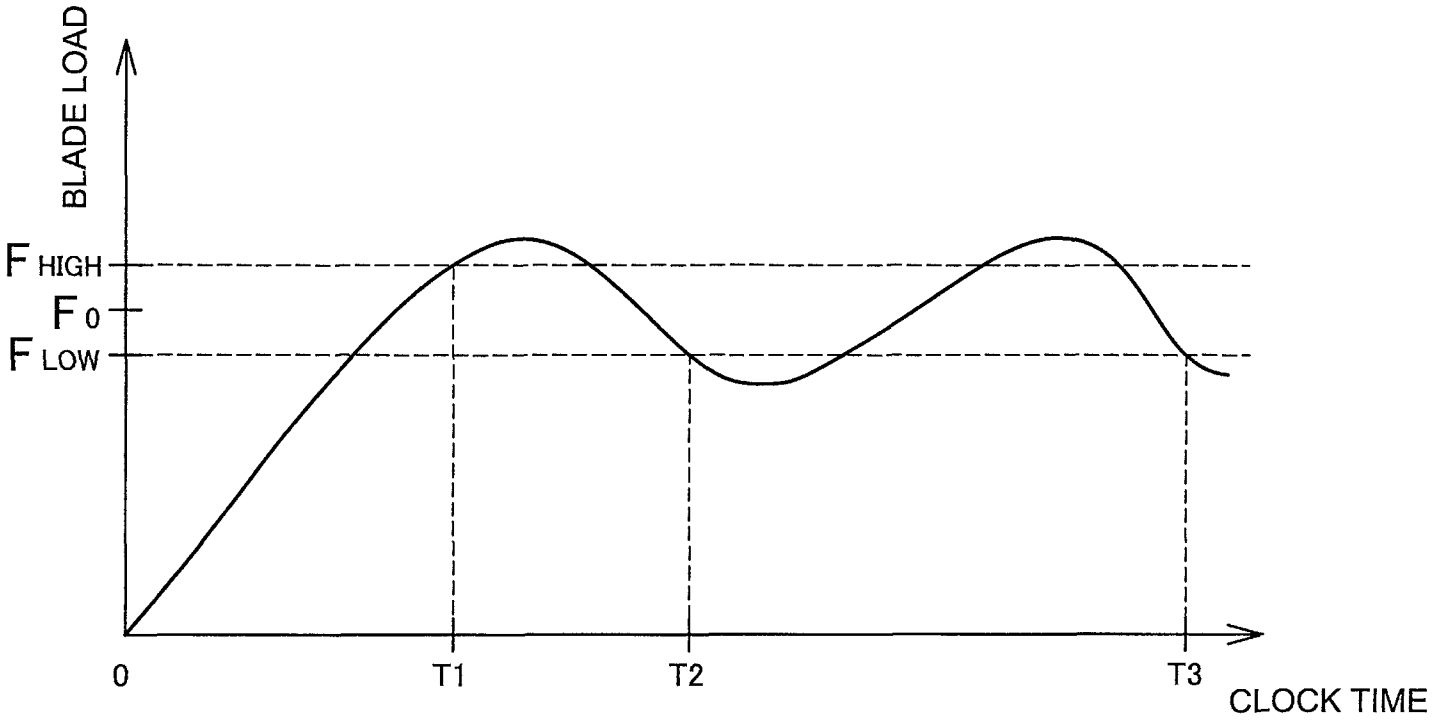
FIG. 8 is a chart representing transition of a blade load in a digging work.

Now, with reference to the drawings, explanation will be made for an exemplary relation between a blade load transition and setting of the virtual designed surface $A_{TEMP}$. FIG. 8 is a chart representing a blade load transition in a digging work. In FIG. 8, the horizontal axis represents time, while the vertical axis represents the magnitude of the blade load. Further, in FIG. 8, clock times T1 to T3 correspond to the respective timings in FIGS. 5 to 7.

As represented in FIG. 8, the blade load is gradually increased from the start of a digging work and becomes greater than the second set load value $F_{HIGH}$ at the clock time T1. The blade controlling part 216 elevates the blade 40 due to the blade load that is greater than the second set load value $F_{HIGH}$.

Thereafter, the blade load is gradually reduced and becomes less than the first set load value $F_{LOW}$ at the clock time T2. At this time, the virtual designed surface setting part 215 recognizes that the blade load has been reduced from a value greater than or equal to the first set load value $F_{LOW}$ to a value less than the first set load value $F_{LOW}$, and sets a virtual designed surface $A_{TEMP1}$ in a position away from the designed surface $A_{STD}$ at a virtual distance $D_{TEMP1}$ (reference distance $D_{STD1}$−correction interval ΔD) (see FIG. 6).

Due to the blade load that is less the first set load value $F_{LOW}$, the blade controlling part 216 thereafter controls the blade 40 not to downwardly go beyond the virtual designed surface $A_{TEMP1}$, although lowering the blade 40 as much as possible. Accordingly, the blade load is gradually increased and becomes greater than the second set load value $F_{HIGH}$. In response, the blade controlling part 216 elevates the blade 40 again.

Thereafter, the blade load is gradually reduced and becomes less than the first set load value $F_{LOW}$ at the clock time T3. At this time, the virtual designed surface setting part 215 recognizes that the blade load has been reduced from a value greater than or equal to the first set load value $F_{LOW}$ to a value less than the first set load value $F_{LOW}$, and sets a virtual designed surface $A_{TEMP2}$ in a position away from the designed surface $A_{STD}$ by a virtual distance $D_{TEMP2}$ (reference distance $D_{STD2}$−correction interval ΔD) (see FIG. 7).

Thereafter, the virtual designed surface setting part 215 and the blade controlling part 216 repeats the aforementioned steps, but discards a set of data regarding the previous virtual designed surface $A_{TEMP}$ in response to backward travelling of the bulldozer 100 by an operator. Further, the virtual designed surface setting part 215 may configured to finish updating the virtual designed surface $A_{TEMP}$ when the virtual designed surface $A_{TEMP}$ is matched with a ground surface GRD.

The storage part 217 stores the first set load value $F_{LOW}$ and the second set load value $F_{HIGH}$ that are used by the blade load determining part 212 and the blade controlling part 216. The second set load value $F_{HIGH}$ is greater than the first set load value $F_{LOW}$. Pieces of information stored in the storage part 217 may be rewritable by an operator through an input device 260.

Action of Blade Control Device 200

Figure 9:
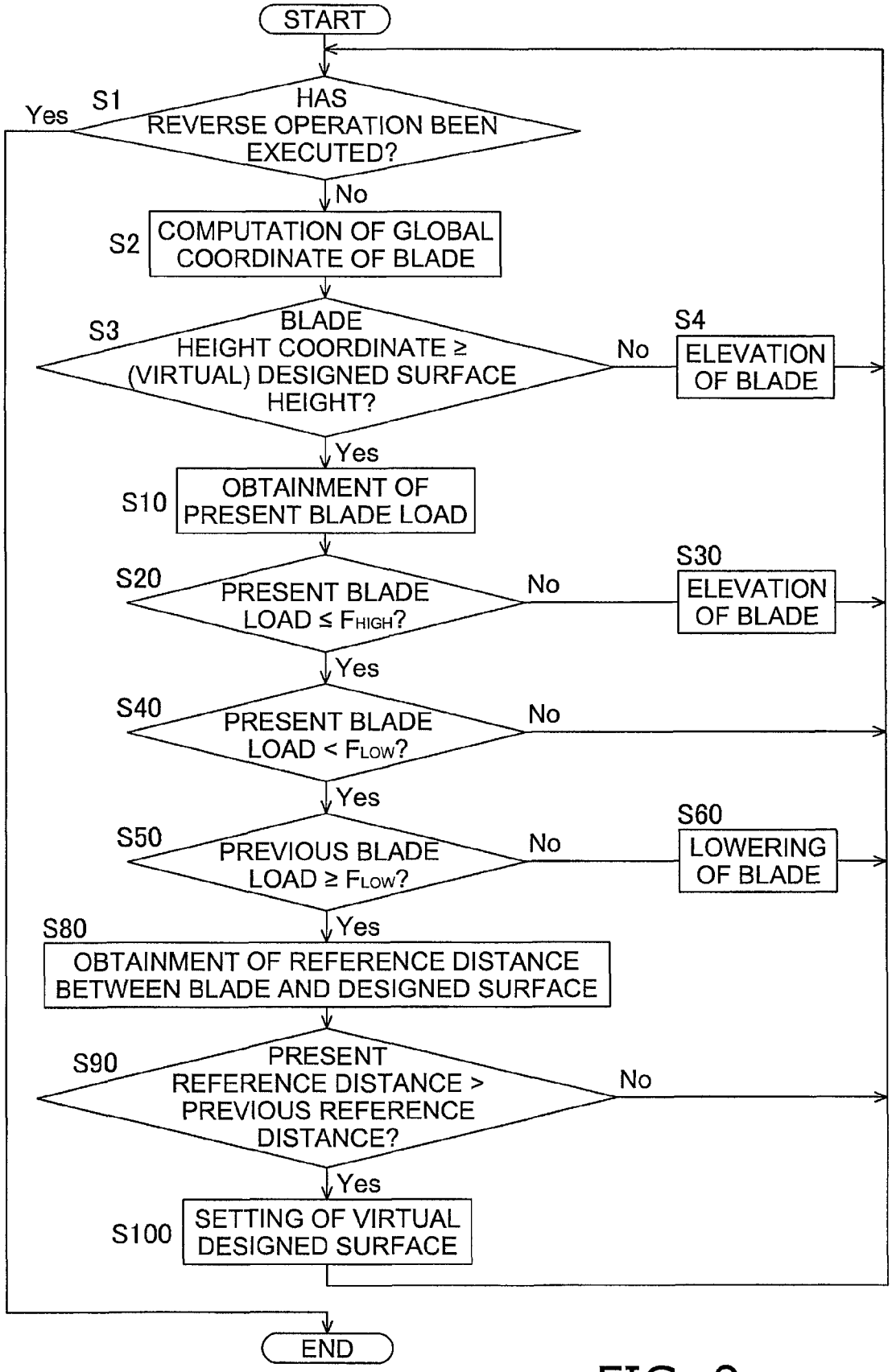
FIG. 9 is a flowchart for explaining an action of the blade control device.

FIG. 9 is a flowchart for explaining an action of the blade control device 200.

It should be noted that the following action is actuated when an operator selects a control mode for actuating the following action.

In Step S1, the blade controller 210 determines whether or not the operator has moved the bulldozer 100 rearwards. When the operator has moved the bulldozer 100 rearwards, the processing is finished. When the operator has not moved the bulldozer 100 rearwards, the processing proceeds to Step S2.

In Step S2, the blade controller 210 computes the global coordinate of the blade 40.

In Step S3, the blade controller 210 determines whether or not the height coordinate of the blade 40 is greater than or equal to either the designed surface $A_{STD}$ or the virtual designed surface $A_{TEMP}$. When the height coordinate of the blade 40 is not greater than or equal to either the designed surface $A_{STD}$ or the virtual designed surface $A_{TEMP}$, the blade controller 210 elevates the blade 40 in Step S4. When the height coordinate of the blade 40 is greater than or equal to either the designed surface $A_{STD}$ or the virtual designed surface $A_{TEMP}$, the processing proceeds to Step S10.

In Step S10, the blade controller 210 obtains the blade load acting on the blade 40.

In Step S20, the blade controller 210 determines whether or not the blade load obtained this time is less than or equal to the second set load value $F_{HIGH}$. When the blade load obtained this time is not less than or equal to the second set load value $F_{HIGH}$, the blade controller 210 elevates the blade 40 in Step S30. When the blade load obtained this time is less than or equal to the second set load value $F_{HIGH}$, the processing proceeds to Step S40.

In Step S40, the blade controller 210 determines whether or not the blade load obtained this time is less than the first set load value $F_{LOW}$. When the blade load is greater than or equal to the first set load value $F_{LOW}$, the processing returns to Step S1. When the blade load is less than the first set load value $F_{LOW}$, the processing proceeds to Step S50.

In Step S50, the blade controller 210 determines whether or not the blade load previously obtained was greater than or equal to the first set load value $F_{LOW}$. When the blade load was not greater than or equal to the first set load value $F_{LOW}$, the blade controller 210 lowers the blade 40 in Step S60. When the blade load was greater than or equal to the first set load value $F_{LOW}$, the processing proceeds to Step S80. Through the aforementioned processing from Step S10 to Step S60, the load of the blade 40 during execution of a work is controlled to fall within an appropriate range.

In Step S80, the blade controller 210 computes the reference distance $D_{STD}$ between the designed surface $A_{STD}$ and the blade 40.

In Step S90, the blade controller 210 determines whether or not the present reference distance $D_{STD}$ is greater than the previous reference distance $D_{STD}$. When the present reference distance $D_{STD}$ is greater than the previous reference distance $D_{STD}$, the processing proceeds to Step S100. When the present reference distance $D_{STD}$ is not greater than the previous reference distance $D_{STD}$, the processing proceeds to Step S1.

In Step S100, the blade controller 210 sets the virtual designed surface $A_{TEMP}$ to be closer to the blade 40 than the designed surface $A_{STD}$ is. Specifically, the blade controller 210 sets the virtual designed surface $A_{TEMP}$ in a position higher than the designed surface $A_{STD}$ by the virtual distance $D_{TEMP}$ (reference distance $D_{STD}$−correction interval ΔD). Then, the processing returns to Step S1.

Actions and Effects (1) When the blade load is reduced from a value greater than or equal to the first set load value $F_{LOW}$ to a value less than the first set load value $F_{LOW}$, the blade control device 200 is configured to set the virtual designed surface $A_{TEMP}$ to be closer to the blade 40 than the designed surface $A_{STD}$ is, and is configured to allow the blade 40 to only pivot above the virtual designed surface $A_{TEMP}$.

Therefore, even when the blade load became less than the first set load value $F_{LOW}$ after blade elevation executed in accordance with the fact that the blade load had become greater than the second set load value $F_{HIGH}$ during a digging work, the blade 40 is controlled so as not to get closer to the designed surface $A_{STD}$ than the virtual designed surface $A_{TEMP}$ is. The blade 40 can be thereby inhibited from being greatly lowered. Accordingly, continuous undulations can be inhibited from being formed on the digging surface.

(2) The blade control device 200 is configured to set the virtual designed surface $A_{TEMP}$ so that the distance between the virtual designed surface $A_{TEMP}$ and the designed surface $A_{STD}$ can be less than the reference distance $D_{STD}$ between the blade 40 and the designed surface $A_{STD}$.

Therefore, a required dozing amount can be reliably obtained while a large undulation can be prevented from being formed on the digging surface.

(3) The blade control device 200 is configured to set a new virtual designed surface $A_{TEMP}$ in a position farther away from the designed surface $A_{STD}$ than the previously set virtual designed surface $A_{TEMP}$ is.

Therefore, even when the virtual designed surface $A_{TEMP}$ is set so that the distance between the virtual designed surface $A_{TEMP}$ and the designed surface $A_{STD}$ can be less than the reference distance $D_{STD}$, the updated virtual designed surface $A_{TEMP}$ can be inhibited from being set to be below the previous virtual designed surface $A_{TEMP}$. Accordingly, an undulation can be further inhibited from being formed on the digging surface.

Other Exemplary Embodiments

An exemplary embodiment of the present invention has been explained above. However, the present invention is not limited to the aforementioned exemplary embodiment, and a variety of changes can be herein made without departing from the scope of the present invention.

(A) In the aforementioned exemplary embodiment, the virtual designed surface $A_{TEMP}$ is configured to be set so that the distance between the virtual designed surface $A_{TEMP}$ and the designed surface $A_{STD}$ can be less than the reference distance $D_{STD}$ between the blade 40 and the designed surface $A_{STD}$. However, the present invention is not limited to this. The virtual designed surface $A_{TEMP}$ may be set so that the distance between the virtual designed surface $A_{TEMP}$ and the designed surface $A_{STD}$ can be equal to the reference distance $D_{STD}$ between the blade 40 and the designed surface $A_{STD}$.

(B) In the aforementioned exemplary embodiment, the blade controller 210 is configured to compute the distance from the designed surface $A_{STD}$ to the cutting edge 40P in the perpendicular direction. However, the present invention is not limited to this. The blade controller 210 may be configured to compute a distance in a direction intersecting with the perpendicular direction. Further or alternatively, the blade controller 210 may be configured to compute a distance from the designed surface $A_{STD}$ to a portion of the blade 40 other than the cutting edge 40P.

(C) The aforementioned exemplary embodiment has been explained by exemplifying the bulldozer as a working machine. However, the present invention is not limited to this. For example, a motor grader or the like can be exemplified as a working machine.

According to the illustrated embodiments, it is possible to provide a blade control device whereby undulation of a digging surface can be inhibited, a working machine and a blade control method. Therefore, the blade control device according to the illustrated embodiments is useful for the field of working machines.

What is claimed is:

1. A blade control device configured to control an up-and-down position of a blade as a work implement to pivotally attached to a vehicle body, the blade control device comprising:

a blade load obtaining part configured to obtain a blade load acting on the blade;

a blade controlling part configured to lower the blade when the blade load is less than a first set load value, the blade controlling part being configured to elevate the blade when the blade load is greater than a second set load value greater than the first set load value, the blade controlling part being configured to allow the blade to pivot above a designed surface, the designed surface being a three-dimensional designed landform indicating a target shape of a digging object;

a distance obtaining part configured to obtain a distance between the designed surface and the blade; and a virtual designed surface setting part configured to set a virtual designed surface to be closer to the blade than the designed surface based on a reference distance, the virtual designed surface being parallel to the designed surface, the reference distance being the distance obtained by the distance obtaining part at the time the blade load is reduced from a value greater than or equal to the first set load value to a value less than the first set load value, the blade controlling part being configured to allow the blade to pivot above the virtual designed surface even though the blade load is less than the first set load value when the virtual designed surface had been set by the virtual designed surface setting part.

2. The blade control device recited in claim 1, wherein the virtual designed surface setting part is configured to set the virtual designed surface so that a distance between the virtual designed surface and the designed surface is equal to the reference distance.

3. The blade control device recited in claim 1, wherein the virtual designed surface setting part is configured to set the virtual designed surface so that a distance between the virtual designed surface and the designed surface is less than the reference distance.

4. The blade control device recited in claim 3, wherein the virtual designed surface setting part is configured to set the virtual designed surface in a position farther away from the designed surface than a previously set virtual designed surface.

5. A working machine comprising:

a vehicle body;

a work implement pivotally attached to the vehicle body; and a blade control device configured to control an up-and-down position of a blade as the work implement, the blade control device including a blade load obtaining part configured to obtain a blade load acting on the blade;

a blade controlling part configured to lower the blade when the blade load is less than a first set load value, the blade controlling part being configured to elevate the blade when the blade load is greater than a second set load value greater than the first set load value, the blade controlling part being configured to allow the blade to pivot above a designed surface, the designed surface being a three-dimensional designed landform indicating a target shape of a digging object;

a distance obtaining part configured to obtain a distance between the designed surface and the blade; and a virtual designed surface setting part configured to set a virtual designed surface to be closer to the blade than the designed surface based on a reference distance, the virtual designed surface being parallel to the designed surface, the reference distance being the distance obtained by the distance obtaining part at the time the blade load is reduced from a value greater than or equal to the first set load value to a value less than the first set load value, the blade controlling part being configured to allow the blade to pivot above the virtual designed surface even though the blade load is less than the first set load value when the virtual designed surface had been set by the virtual designed surface setting part.

6. A blade control method of controlling an up-and-down position of a blade as a work implement pivotally attached to a vehicle body, the blade control method comprising:

setting a virtual designed surface to be closer to the blade than a designed surface based on a reference distance between the designed surface and the blade, the designed surface being a three-dimensional designed landform indicating a target shape of a digging object, the virtual designed surface being parallel to the designed surface, the reference distance being a distance between the designed surface and the blade at the time a blade load acting on the blade is reduced from a value greater than or equal to a first set load value to a value less than the first set load value; and allowing the blade to pivot above the virtual designed surface.

7. The blade control method recited in claim 6, further comprising:

lowering the blade when the blade load is less than the first set load value and elevating the blade when the blade load is greater than a second set load value greater than the first set load value, while allowing the blade to pivot above a designed surface, the designed surface being a three-dimensional designed landform indicating a target shape of a digging object, the allowing of the blade to pivot above the virtual designed surface including:

setting a virtual designed surface to be above the designed surface, and allowing the blade to pivot above the virtual designed surface even though the blade load is less than the first set load value when the virtual designed surface had been set.

* * * * *